US005783145A

United States Patent [19]

Coutu et al.

[11] Patent Number: 5,783,145

[45] Date of Patent: Jul. 21, 1998

[54] IRON-NICKEL ALLOY AND COLD-ROLLED STRIP WITH A CUBIC TEXTURE

[75] Inventors: Lucien Coutu, Chauvigny-lés-Bois; Pierre Louis Reydet, Gimouille, both of France

[73] Assignee: Imphy S.A., Puteaux, France

[21] Appl. No.: 807,771

[22] Filed: Feb. 27, 1997

[30] Foreign Application Priority Data

Feb. 27, 1996 [FR] France ..... 96 02404

[51] Int. Cl.[6] ..... C21D 8/12; C22C 38/40; C22C 19/03; C22C 30/00

[52] U.S. Cl. ..... 420/94; 420/95; 420/96; 420/453; 420/454; 420/581; 148/310; 148/312; 148/120; 148/122; 148/651; 148/121

[58] Field of Search ..... 420/94, 95, 96, 420/581, 452, 453, 454; 148/300, 651, 310, 312, 122, 120, 121

[56] References Cited

U.S. PATENT DOCUMENTS

| | | | |
|---|---|---|---|
| 3,425,043 | 1/1969 | Olsen et al. . | |
| 3,647,426 | 3/1972 | Wache | 420/94 |
| 3,723,106 | 3/1973 | Schlenker et al. . | |
| 5,211,771 | 5/1993 | Okiyama et al. | 148/312 |
| 5,304,346 | 4/1994 | O'Donnell et al. | 420/94 |

FOREIGN PATENT DOCUMENTS

| | | | |
|---|---|---|---|
| A-2507627 | 12/1982 | France . | |
| 53-7527 | 1/1978 | Japan | 148/310 |

OTHER PUBLICATIONS

JP–4120233, Japanese (Abstract), Dated Apr. 21, 1992.

*Primary Examiner*—Deborah Yee
*Attorney, Agent, or Firm*—Oblon, Spivak, McClelland, Maier & Neustadt, P.C.

[57] ABSTRACT

An iron-nickel alloy, the chemical composition of which includes by weight:

$30\% \leqq Ni+Co \leqq 85\%$;

$0\% \leqq Co+Cu+Mn \leqq 10\%$;

$0\% \leqq Mo+W+Cr \leqq 4\%$;

$0\% \leqq V+Si \leqq 2\%$;

$0\% \leqq Nb+Ta \leqq 1\%$;

$0.003\% \leqq C \leqq 0.05\%$ $0.003\% \leqq Ti \leqq 0.15\%$;

$0.003\% \leqq Ti+Zr+Hf \leqq 0.15\%$;

$0.001\% < S+Se+Te < 0.015\%$;

and the remainder, iron and impurities resulting from production; in addition, the chemical composition satisfies the relationship:

$0 \leqq Nb+Ta+Ti+Al \leqq 1\%$.

A cold-rolled strip with a cubic texture and its uses.

13 Claims, No Drawings

IRON-NICKEL ALLOY AND COLD-ROLLED STRIP WITH A CUBIC TEXTURE

BACKGROUND OF THE INVENTION

1. Field of the Invention

This invention concerns an iron-nickel alloy. Articles comprising the invention alloy, strips of the invention alloy, and processes of making and using the invention alloy also make up a part of the invention.

2. Discussion of the Background

Iron-nickel alloys, the chemical composition of which includes by weight from 27% to 60% nickel, 0 to 7% cobalt, the remainder being iron and impurities resulting from production, are used as cold-rolled and annealed strips, particularly in manufacturing soft magnetic cores. The annealing on very hammer-hardened cold-rolled strips has the advantage of giving these alloys a cubic recrystallization structure with magnetic properties that are very advantageous for certain applications, such as coiled cores for magnetic amplifiers. In particular, iron-nickel alloy strips with a cubic structure have a very rectangular hysteretic cycle (Br/Bs>95%).

These alloys, however, have the disadvantage of being difficult to manufacture. The annealing temperature range favorable for obtaining a good texture and satisfactory magnetic properties is too narrow, less than 25° C., for reliable production, particularly because the position of this temperature range depends on little known parameters.

SUMMARY OF THE INVENTION

One object of this invention is to remedy this disadvantage by providing an iron-nickel alloy that is easier to make than the alloys according to previous technology.

For this purpose, the object of the invention is provided by an iron-nickel alloy having with a chemical composition that includes, by weight based on total alloy weight:

$$30\% \leqq Ni+Co \leqq 85\%$$

$$0\% \leqq Co+Cu+Mn \leqq 10\%$$

$$0\% \leqq Mo+W+Cr \leqq 4\%$$

$$0\% \leqq V+Si \leqq 2\%$$

$$0\% \leqq Nb+Ta \leqq 1\%$$

$$0.003\% \leqq C \leqq 0.05\%$$

$$0.003\% \leqq Ti \leqq 0.15\%$$

$$0.003\% \leqq Ti+Zr+Hf \leqq 0.15\%$$

$$0.001\% \leqq S+Se+Te \leqq 0.015\%$$

and the remainder, mostly or wholly iron and impurities resulting from production. The chemical composition preferably also satisfies the relationship: $0 \leqq Nb+Ta+Ti+Al \leqq 1\%$. Also, preferably, the chemical composition is such that $0.005\% \leqq Ti \leqq 0.05\%$ and $0.001\% \leqq Hf+Zr \leqq 0.025\%$ It is also preferable that:

$$0.002\% \leqq S \leqq 0.007\%$$

and it is desirable that:

$$0.005\% \leqq C \leqq 0.02\%.$$

These preferred ranges may all be present, or less than all may be present.

Preferably, the manganese content should be above 0.05%, and it is not preferred for it to be above 1%. In the same way, it is preferable that $Nb+Ta \leqq 0.05\%$.

It is desirable that the impurity contents be as follows:

$$Mg<0.001\%$$

$$Ca<0.0025\%$$

$$Al \leqq 0.05\%$$

$$O<0.0025\%$$

$$N<0.005\%$$

$$P<0.01\%$$

$$Sc+Y+La+Ce+Pr+Nd+Sm<0.01\%$$

The invention also concerns an iron-nickel alloy cold-rolled strip in accordance with the invention preferably having a recrystallization with a cubic texture of a (100) <001> type, and its presence in and use in the manufacture of articles such as a shadow filter for a cathode display tube, a toroidal magnetic core, etc. A method of making the invention alloy also makes up part of the invention.

DESCRIPTION OF THE PREFERRED EMBODIMENTS

The invention is now going to be described in a way that is more precise but not exhaustive, and it will be illustrated by the examples that follow.

The inventors unexpectedly noted that by adding a small amount of titanium, accompanied in some cases by small amounts of Zr or Hf with small amounts of S, Se, or Te and in some cases, Nb, Ta, C, or Mn, to an iron-nickel alloy that otherwise conformed to the previous technology, the alloy's annealing temperature range widened noticeably, making it possible to obtain a cubic texture (100)<001> very favorable to the obtention of good magnetic properties. With these additions, the width (i.e., window) of the satisfactory annealing temperature range exceeds 50° C., while usually this width is less than 25° C.

The iron-nickel alloys concerned that can have a cubic structure primarily contain iron and nickel, and cobalt can partially substitute for the nickel. They may also contain chiefly: copper, manganese, molybdenum, tungsten, vanadium, chromium, and silicon.

Expressed in weight by percent based on total weight, the contents of these elements are the following:

$$30\% \leqq Ni+Co \leqq 85\%$$

$$0\% \leqq Co+Cu+Mn \leqq 10\%$$

$$0\% \leqq Mo+W+Cr \leqq 4\%$$

$$0\% \leqq V+Si \leqq 2\%$$

The rest of the composition comprises iron, the natural elements in the invention, and impurities.

For these alloys to have a cubic texture, it is also preferred that, if they contain titanium, aluminum, niobium, and tantalum, they have:

$$Ti+Al+Nb+Ta \leqq 1\%.$$

The impurities are chiefly: magnesium, calcium, aluminum, oxygen, nitrogen, phosphorus, and rare earths. Preferably, the contents of these elements are as follows:

Mg<0.001%

Ca<0.0025%

Al≦0.05%

O<0.0025%

N<0.005%

P<0.01%

Sc+Y+La+Ce+Pr+Nd+Sm<0.01%.

In accordance with the preferred objects of the invention, the alloy contains:

from 0.003% to 0.15% titanium, including 0.008, 0.01, 0.015, 0.1, 0.12 and all values and subranges between all given values.

in some cases, at least one element from among Zr and Hf, with the total of the Ti, Zr, and Hf contents between 0.003% and 0.15%; it is preferable to have simultaneously 0.005%≦Ti ≦0.05% and 0.001%≦Hf+Zr≦0.025%;

from 0.003% to 0.05% and, preferably, from 0.005% to 0.02% carbon;

in some cases, at least one element of either Nb and Ta, with the total content of these elements preferably not exceeding 0.05%;

preferably, more than 0.05% manganese; when a high addition of manganese is not effective or not desirable, the content of this element is limited to 1%.

This alloy can be produced in an arc furnace, cast continuously as a slab, a thin strip, or an ingot, then hot rolled in the form of a hot strip. The hot strip is then cold rolled with a cold rolling efficiency above 80 and preferably above 90% to obtain a cold-rolled strip.

When the cold-rolled strip is intended for making toroidal magnetic cores, the annealing should give the alloy not only a cubic texture, but also the lowest coercive field possible. In this case it is preferable first to cut and roll up the strip to form a toroidal core. The toroidal core is then annealed at a temperature between 850° C. and 1200° C. to cause primary recrystallization that engenders the formation of a (100) <001> cubic texture. The annealing temperature should be adjusted on one hand to remain below critical temperature of the gigantic grain secondary recrystallization and, on the other hand, for the Bm, Bm-Br, H1, and ΔH magnitudes measured by the CCFR method according to the ASTM A598-92 standard in the chapter "Standard Method for Magnetic Properties of Magnetic Amplifier Cores" to be the following:

Bm>14,500 Gauss

Bm-Br<400 Gauss

H1 between 0.15 and 0.30 Oersteds

ΔH<0.035 Oersteds.

The cold-rolled strip can also be heat treated with in some cases fewer restraints on the search for magnetic properties. This is especially the case when the nickel content is in the neighborhood of 36%, and the strip is used to manufacture shadow filters for cathode display tubes; the cubic texture is, in fact, particularly advantageous for a good quality of hole punching by chemical engraving. Annealing is then done at a temperature above 550° C. and lower than the secondary recrystallization temperature. When it is not necessary to have a particularly low coercive field, the annealing temperature is generally below 800° C.

EXAMPLES

By way of example, and to show the effects of the invention, the critical temperatures for the appearance of gigantic grain secondary recrystallizations of cold-rolled alloys A (according to the previous technology) and B (according to the invention) with cold rolling efficiencies of 83%, 90%, and 95% were determined. The critical temperatures were determined by using a temperature gradient furnace.

The chemical compositions of the alloys were, in % by weight:

| | Fe | Ni | Mn | Si | C | S | Al | Ti | Hf |
|---|---|---|---|---|---|---|---|---|---|
| A | bal | 36.1 | 0.4 | 0.09 | 0.005 | 7 ppm | <0.005 | 0 | 0 |
| B | bal | 36.4 | 0.3 | 0.1 | 0.012 | 30 ppm | 0.01 | 0.019 | 0.007 |

For different cold rolling efficiencies, the critical temperatures were:

| | 83% | 90% | 95% |
|---|---|---|---|
| A | 970° C. | 1020° C. | 1040° C. |
| B | 1060° C. | 1090° C. | 1090° C. |

These examples show that the alloy in accordance with the invention keeps a cubic texture at a temperature above 1050° C., even with relatively low cold rolling efficiency (83%), and in all cases, above 50° C. at the alloy's recrystallization temperatures according to the previous technology.

Also by way of example and comparison, alloys 1, 2, and 3 produced according to the previous technology and alloys 4, 5, and 6, in accordance with the invention. These alloys cold-rolled in the form of strips 0.05 mm wide with 95% rolling efficiencies, and then the annealing temperature range, which makes it possible to obtain a (100)<001> cubic texture, and the magnetic properties mentioned above were determined.

The chemical compositions were, in % by weight:

| alloy | Fe* | Ni | Mn | Si | C | S | Al | Ti | Zr | Hf | Nb |
|---|---|---|---|---|---|---|---|---|---|---|---|
| 1 | Bal | 47.5 | 0.38 | 0.1 | 0.007 | 0.005 | <0.005 | — | — | — | — |
| 2 | Bal | 47.8 | 0.51 | 0.21 | 0.005 | 0.005 | <0.005 | — | — | — | — |
| 3 | Bal | 48 | 0.49 | 0.23 | 0.001 | 0.004 | <0.005 | — | — | — | — |
| 4 | Bal | 47.5 | 0.48 | 0.22 | 0.009 | 0.005 | <0.005 | 0.021 | 0.003 | — | — |
| 5 | Bal | 47.4 | 0.49 | 0.24 | 0.008 | 0.004 | 0.0011 | 0.023 | — | — | 0.02 |
| 6 | Bal | 47.5 | 0.26 | 0.01 | 0.0011 | 0.005 | 0.015 | 0.023 | — | 0.002 | 0.026 |

*Fe and impurities

The magnetic properties and the satisfactory annealing temperature range were:

| alloy | Bm (gauss) | Bm-Br (gauss) | H1 (Oersteds) | ΔH (Oersteds) | ϕ annealing satisfactory °C. |
|---|---|---|---|---|---|
| 1 | 14,800 | 140 | 0.34 | 0.042 | — |
| 2 | 14,500 | 170 | 0.36 | 0.021 | — |
| 3 | 14,600 | 240 | 0.27 | 0.032 | 975/1000 |
| 4 | 14,500 | 190 | 0.28 | 0.029 | 1040/1100 |
| 5 | 14,700 | 130 | 0.28 | 0.024 | 950/1050 |
| 6 | 15,000 | 140 | 0.26 | 0.031 | 1000/1100 |

From these results it can be seen that with alloys 1 and 2 according to the previous technology, it is not possible to obtain all the necessary magnetic characteristics, namely: Bm >14,500 Gauss, Bm-Br<400 Gauss, H1 between 0.15 and 0.30 Oersteds, ΔH<0.035 Oersteds. For alloy 3 in accordance with the previous technology, the satisfactory annealing temperature field has a range of 25° C., for alloys 4, 5, and 6, the satisfactory annealing temperature field has a range of 60° C., 100° C., and 100° C. respectively. These examples illustrate clearly the difficulties encountered with alloys according to the earlier technology and the advantage contributed by the invention.

In the above description of the invention, the weight ranges, performance values, temperature ranges etc., all fully include all values, ranges and subranges between all given values.

This application is based on French Application 96-02404 filed Feb. 27, 1996, incorporated herein by reference.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. An iron-nickel alloy comprising, by weight based on total weight:

$30\% \leqq Ni+Co \leqq 85\%$ $0\% \leqq Co+Cu+Mn \leqq 10\%$ $0\% \leqq Mo+W+Cr \leqq 4\%$ $0\% \leqq V+Si \leqq 2\%$ $0\% \leqq Nb+Ta \leqq 1\%$ $0.003\% \leqq C \leqq 0.05\%$ $0.005\% \leqq Ti \leqq 0.05\%$ $0.001\% \leqq Zr+Hf \leqq 0.25\%$ $0.001\% < S+Se+Te < 0.015\%$ iron and impurities resulting from production; wherein the alloy further satisfies the relationship:

$0 \leqq Nb+Ta+Ti+Al \leqq 1\%$.

2. An iron-nickel alloy according to claim 1, wherein:

$0.002\% \leqq S \leqq 0.007\%$.

3. An iron-nickel alloy according to claim 1, wherein:

$0.005\% \leqq C \leqq 0.02\%$.

4. An iron-nickel alloy according to claim 1, wherein:

$0.05\% \leqq Mn$.

5. An iron-nickel alloy according to claim 1, wherein:

$Mn \leqq 1\%$.

6. An iron-nickel alloy according to claim 1, wherein:

$Nb+Ta \leqq 0.05\%$.

7. An iron-nickel alloy according to claim 1, wherein the alloy further comprises:

$Mg < 0.001\%$ $Ca < 0.0025\%$ $Al \leqq 0.05\%$ $O < 0.0025\%$ $N < 0.005\%$ $P < 0.01\%$ and further satisfies the relationship:

$Sc+Y+La+Ce+Pr+Nd+Sm < 0.01\%$.

8. A process for manufacturing a cold-rolled alloy strip comprising the steps of providing a hot rolled strip of an iron-nickel alloy comprising, by weight based on total weight:

$30\% \leqq Ni+Co \leqq 85\%$ $0\% \leqq Co+Cu+Mn \leqq 10\%$ $0\% \leqq Mo+W+Cr \leqq 4\%$ $0\% \leqq V+Si \leqq 2\%$ $0\% \leqq Nb+Ta \leqq 1\%$ $0.003\% \leqq C < 0.05\%$ $0.005\% \leqq Ti \leqq 0.05\%$ $0.001\% \leqq Zr+Hf \leqq 0.025\%$ $0.001\% < S+Se+Te < 0.015\%$ iron and impurities resulting from production; wherein the alloy further satisfies the relationship:

$0 \leqq Nb+Ta+Ti+Al \leqq 1\%$ cold-rolling the hot rolled strip with a cold rolling efficiency above 80%, annealing the cold-rolled strip at a temperature above 550° C. and below the alloy's secondary recrystallization temperature to give it a cubic texture.

9. A process for manufacturing an alloyed toroidal magnetic core comprising the steps of:

providing a cold-rolled alloy strip comprising, by weight based on total weight:

$30\% \leqq Ni+Co \leqq 85\%$ $0\% \leqq Co+Cu+Mn \leqq 10\%$ $0\% \leqq Mo+W+Cr \leqq 4\%$ $0\% \leqq V+Si \leqq 2\%$ $0\% \leqq Nb+Ta \leqq 1\%$ $0.003\% \leqq C \leqq 0.05\%$ $0.005\% \leqq Ti \leqq 0.05\%$ $0.001\% \leqq Zr+Hf \leqq 0.025\%$ $0.001\% < S+Se+Te < 0.015\%$ iron and impurities resulting from production; wherein the alloy further satisfies the relationship:

$0 \leqq Nb+Ta+Ti+Al \leqq 1\%$ by cold rolling said alloy with a cold-rolling efficiency above 80%, forming a toroidal core from said strip, annealing the toroidal core at a temperature above 850° C. and below the alloy's secondary recrystallization temperature.

10. The alloy of claim 1, wherein said alloy is in the form of an iron-nickel alloyed cold-rolled strip comprising, by weight based on total weight:

$30\% \leqq Ni+Co \leqq 85\%$ $0\% \leqq Co+Cu+Mn \leqq 10\%$ $0\% \leqq Mo+W+Cr \leqq 4\%$ $0\% \leqq V+Si \leqq 2\%$ $0\% \leqq Nb+Ta \leqq 1\%$ $0.003\% \leqq C \leqq 0.05\%$ $0.005\% \leqq Ti \leqq 0.15\%$ $0.001\% \leqq Zr+Hf \leqq 0.025\%$ $0.001\% < S+Se+Te < 0.015\%$ iron and impurities resulting from production; wherein the alloy further satisfies the relationship:

$0 \leqq Nb+Ta+Ti+Al \leqq 1\%$ and having a (100)<001> cubic recrystallization texture.

11. The alloy of claim 1, wherein said alloy is in the form of, or makes up a part of, a shadow filter for a cathode display tube.

12. The alloy of claim 1, wherein said alloy is in the form of an alloyed toroidal magnetic core comprising, by weight based on total weight:

$30\% \leqq Ni+Co \leqq 85\%$ $0\% \leqq Co+Cu+Mn \leqq 10\%$ $0\% \leqq Mo+W+Cr \leqq 4\%$ $0\% \leqq V+Si \leqq 2\%$ $0\% \leqq Nb+Ta \leqq 1\%$ $0.003\% \leqq C \leqq 0.05\%$ $0.005\% \leqq Ti \leqq 0.025\%$ $0.001\% \leqq Zr+Hf \leqq 0.025\%$ $0.001\% < S+Se+Te < 0.015\%$ iron and impurities resulting from production; wherein the chemical composition further satisfies the relationship:

$0 \leqq Nb+Ta+Ti+Al \leqq 1\%$.

13. A method of making an iron-nickel alloy, comprising alloying together the following elements in the following weight amounts based on total weight:

$30\% \leqq Ni+Co \leqq 85\%$ $0\% \leqq Co+Cu+Mn \leqq 10\%$ $0\% \leqq Mo+W+Cr \leqq 4\%$ $0\% \leqq V+Si \leqq 2\%$ $0\% \leqq Nb+Ta \leqq 1\%$ $0.003\% \leqq C \leqq 0.05\%$ $0.005\% \leqq Ti \leqq 0.05\%$ $0.001\% \leqq Zr+Hf \leqq 0.025\%$ $0.001\% < S+Se+Te < 0.015\%$ and iron; wherein the elements further satisfy the relationship:

$0 \leqq Nb+Ta+Ti+Al \leqq 1\%$.

* * * * *